US006659784B1

(12) United States Patent
Klein et al.

(10) Patent No.: US 6,659,784 B1
(45) Date of Patent: Dec. 9, 2003

(54) CONNECTOR WITH SWITCHING DEVICE

(75) Inventors: Mickael Klein, Le Mans (FR); El Mostafa Zindine, Cherreau (FR); Herve Le Gallic, Cherreau (FR); Bernard Robert, Pontarlier (FR)

(73) Assignee: Framatome Connectors Inc., Courbevoie (FR)

( * ) Notice: Subject to any disclaimer, the term of this patent is extended or adjusted under 35 U.S.C. 154(b) by 0 days.

(21) Appl. No.: 09/857,101

(22) PCT Filed: Dec. 2, 1999

(86) PCT No.: PCT/EP99/09418

§ 371 (c)(1),
(2), (4) Date: Aug. 24, 2001

(87) PCT Pub. No.: WO00/33425

PCT Pub. Date: Jun. 8, 2000

(30) Foreign Application Priority Data

Dec. 2, 1998 (FR) ..... 98 15230
Dec. 10, 1998 (FR) ..... 98 15619

(51) Int. Cl.[7] ..... H01R 29/00

(52) U.S. Cl. ..... 439/188; 439/63; 439/83; 439/733.1; 439/744; 439/931; 439/944; 200/51.1

(58) Field of Search ..... 439/63, 83, 744, 439/733.1, 931, 188, 944; 200/51.1, 51.09

(56) References Cited

U.S. PATENT DOCUMENTS

| | | | | |
|---|---|---|---|---|
| 4,633,048 A | | 12/1986 | Komatsu | 200/51.1 |
| 5,368,494 A | | 11/1994 | Lai | 439/188 |
| 5,413,502 A | | 5/1995 | Wang | 439/551 |
| 5,453,028 A | * | 9/1995 | Grambley et al. | 439/441 |
| 5,741,146 A | | 4/1998 | Henry et al. | 439/188 |
| 5,977,499 A | * | 11/1999 | Black et al. | 200/303 |
| 6,000,969 A | * | 12/1999 | Reichardt et al. | 439/630 |
| 6,030,240 A | * | 2/2000 | Duff | 439/188 |

FOREIGN PATENT DOCUMENTS

| | | |
|---|---|---|
| EP | 0692841 A1 | 1/1996 |
| GB | 2307113 | 5/1997 |
| WO | WO 96/33530 | 10/1996 |
| WO | WO 97/01876 | 1/1997 |

* cited by examiner

*Primary Examiner*—Tho D. Ta
*Assistant Examiner*—Truc Nguyen
(74) *Attorney, Agent, or Firm*—Perman & Green, LLP

(57) ABSTRACT

In order to switch, especially aerials, between two channels while at the same time ensuring pressure contact with a sufficiently wide contact area, a connector (1) is made which includes a resilient switching blade (3) provided with a side arm (4). This side arm (4) ensures linear contact with a pin (7) of another connector, especially a coaxial connector (70). This improvement means that such a connector is simple to use, to mount on a printed circuit.

22 Claims, 8 Drawing Sheets

CONNECTOR WITH SWITCHING DEVICE

This application claims the benefit of the earlier filed International Application No. PCT/EP99/09418, International Filing Date, Dec. 2, 1999, which designated the United States of America, and which international application was published under PCT Article 21(2) in English as WO Publication No. WO 00/33425.

The subject of the present invention is a connector provided with a switching device of the kind described in the preamble portion of patent claim 1. Such a connector is known for example from U.S. Pat. No. 5,741,146.

The invention can be used especially for switching between two aerial channels dedicated, for example, to mobile telephony. In this field, this type of connector is designed to allow switching, especially in a radio frequency range going from a few hundred MHz to a few GHz, from an internal aerial of a mobile telephone, used in portable mode, to an aerial external to the mobile telephone, for example that of a vehicle, to which external aerial the mobile telephone would be connected as required. The invention finds its justification more particularly in the mounting of such connectors on a printed circuit.

U.S. Pat. No. 4,633,048 describes a jack with a switch having a movable contact in a structure in which the contact is driven and separated from a fixed contact when the plug is inserted thereinto and the movable contact is brought into contact electrically with the plug. The housing of the jack has a longitudinal extension, which does not allow certain applications where a compact structure is obligatory.

U.S. Pat. No. 5,741,146 discloses a connector provided with a device for switching between two channels, this device including a first, fixed blade connected to a first channel and a second resilient switching blade exerting a contact pressure either on the first, fixed blade or on a pin of another connector, this pin being connected to a second channel and being inserted as required into the connector and wherein the second end of each blade is bent over in a same contact plane so that it is parallel to a contact surface on a printed circuit board and further comprising a hollow body inside which said device for switching is mounted, the second ends of the contact blades are supported by pins that give them a poor alignment with respect to a reference plane. The object of the invention is to propose a switch connector having a simple structure, compatible with the requirements of miniaturization, easy to mount on a printed-circuit board with an improved and more accurate alignment of the second ends of the blades in a predetermined contact plane of a printed circuit board and allowing effective and noise-free transmission within a radio frequency range.

A connector of this type consists of a hollow body inside which the aerial switching is carried out by means of two blades. The blades, when they are in electrical contact with each other, ensure connection between a transmitter/receiver and the internal aerial or, when they are separated (when introducing a coaxial plug of another connector into the hollow body), ensure connection between the transmitter/receiver and an external aerial. The advantage of the invention lies in the improvement and the simplification of these connections.

The coaxial pin of the other connector in most cases has a circular cylindrical shape. The contact thus formed between this pin and the resilient switching blade of the connector is a quasi-point contact in the case of a non-deformable material. In reality, the materials are not completely non-deformable, especially the switching blade which is resilient. Thus, a so-called quasi-point contact is in fact a contact in which the contact region is not a point but an area. However, in practice, given the dimensions of the components making the contact with respect to this contact area, it may be assumed that this area is sufficiently small to be regarded as a point. In fact, this contact area extends circularly at most over a quarter of the cross section of the circular cylindrical pin. This will constitute hereafter the definition of a point contact.

This type of connector has problems. With the requirements of miniaturization, the point contact area obtained is, for a pin less than 0.7 mm in diameter, less than 0.1 $mm^2$. This type of contact is therefore not sufficiently effective to ensure that information is correctly transmitted or received. The effectiveness is in fact directly related to the quality of the electrical linkage produced. In addition, the contact resistance increases as the contact area decreases. A problem arises, especially when transmitting signals via the external aerial. This is because a signal emitted by this aerial may, in the case of mobile telephony, have a maximum peak power of up to eight watts. Thus, the transmission of such a signal through a point contact has the effect of causing the point of contact to heat up. This heat-up increases the rate of degradation of the contact, especially by oxidation. This causes accelerated reduction in the quality of the transmission of the signal from the transmitter to the external aerial.

Furthermore, another problem arises with regard to fastening such a connector to a printed circuit. The use of screws for doing this fastening is illusory,since the screws necessary would be too small to allow them to be easily handled by an operator. This therefore makes the fastening of these connectors to a printed circuit complicated, and therefore goes counter to the concern, expressed above, for simplicity.

A further object of the present invention is to remedy the problems mentioned by proposing a connector which includes a resilient switching blade allowing surface contact with a pin of another connector. The purpose of this surface contact is to improve the transmission qualities of a signal from a transmitter to an aerial or of a signal from, an aerial to a receiver, while at the same time satisfying the miniaturization requirements. Thus, with this surface contact, the overall contact area is increased. By increasing the overall contact area, the contact resistance is reduced.

A further object of the present invention is to provide an effective solution to these coplanarity problems by using a novel technique or technology for designing the present miniature coaxial switch or changeover-switch connector. This technique concerns the metallization of plastics, more particularly known by the name MID (Moulded Interconnection Device).

The invention thus aims to provide a miniature switch connector intended to be surface-mounted on a printed-circuit board, which includes a hollow plastic body comprising, at one of its ends, an opening intended to receive a connection plug which engages, during its insertion into this opening, with a resilient contact blade in order to separate the latter from a conductive surface, this contact blade and this conductive surface being connected to two conductive areas located at that end of the hollow body which is on the opposite side from the said opening.

According to the invention, this switch connector is characterized in that the said conductive surface consists of a metallized layer applied to part of the internal surface of the hollow plastic body. Further, the two conductive areas are coplanar and consist of two metallized layers applied to the external plane face of the hollow body which is on the opposite side from the said opening.

Given that the two metallized layers which act as output pads or terminals of the connector are applied to a plane face of the hollow body, the coplanarity of the two metallized surfaces is thus guaranteed, which in turn allows the connector to be surface-mounted extremely well.

In the invention, in practice two contact regions are made on the pin of the other connector. A first contact region defines a point contact, as described above, the second contact region being offset to the periphery of the pin. This has the effect of reducing the overall contact resistance due to connection between the resilient switching blade and the pin of the other connector. It will be seen that an elastic reaction, ensuring the first contact, is obtained by the elasticity of the resilient blade in its anchoring. The second contact is obtained by the elasticity of a side arm of this resilient blade. In order to ensure simple and effective fastening of this connector to a printed circuit, it is mounted using a surface mounting technique. Nevertheless, the elasticity of the arm allows firm contact to be made even if the anchoring is relatively fragile, especially when it results from surface mounting with a single soldered joint.

The invention therefore also relates to a connector provided with a device for switching between two channels, this device including a first, fixed blade connected to a first channel and a second, resilient switching blade exerting a contact pressure either on the first, fixed blade or on a pin of another connector, this pin being connected to a second channel and being inserted as required into the connector, characterized in that the pin comes into contact with the second blade at two points which are offset one with respect to the other on the periphery of the pin.

Preferably, a second contact of the second blade with this pin is obtained because this second blade includes a curved side arm which projects so as to be perpendicular to one surface of this second blade and a curvature of which is made along this projection.

The invention will be more clearly understood on reading the description which follows and on examining the figures which accompany it. They are presented only by way of indication and in no way restrict the invention. The figures show:

FIG. 1: a sectional view of a connector according to the invention with a resilient switching blade exerting a contact pressure on a fixed blade;

FIG. 2: the same connector according to the invention, with the resilient switching blade exerting a contact pressure on a pin of another connector;

FIG. 3: a fixed blade of the connector according to the invention;

FIG. 4: a resilient switching blade of the connector according to the invention;

FIG. 5: a view of the base of the connector according to the invention;

FIG. 6: a view of an insulating structure of the connector according to the invention;

FIG. 7: a view of a plug for aligning and retaining the connector according to the invention;

FIG. 8: a view of a conducting skirt of the connector according to the invention; and FIG. 9: an example of the application of the connector according to the invention in a mobile telephone;

FIG. 10: a sectional view of another embodiment of a connector according to the present invention;

FIG. 11: a sectional view of still another embodiment of a connector according to the invention;

FIG. 12: a perspective view of the connector housing according to FIG. 11;

FIG. 13: the switching blade of the connector according to FIG. 11.

FIG. 1 shows a sectional view of a connector 1 according to the invention, provided with a fixed blade 2 and with a resilient switching blade 3. When no other connector is connected to the connector 1, the blade 3 is in contact, by pressure, with the fixed blade 2. This contact is in fact produced by means of a side arm 4 which projects perpendicularly to one surface of the switching blade 3. More specifically, the region of contact with the fixed blade 2 on the side arm 4 is located at a corner 5 of a free end 6 of the side arm 4. The switching blade 3 is elongate and approximately plane. Three-quarters of the way up the switching blade, there is the arm 4. At the start of manufacture, the arm 4, cut together with the switching blade 3 from the same metal sheet and integral with the switching blade, is in the same plane as the switching blade. The side arm 4 then has a height oriented like the length of the switching blade 3. The free end 6 of the arm is approximately parallel to this height. Near the upper corner 5, the free end 6 is cut so as to be round. Furthermore, the plane of the switching arm 3 is then deformed in order to include a curvature of the free end 6. The radius of curvature lies in a plane perpendicular to the length of the switching blade 3. The side arm 4 is then bent over by folding or bending. The rounded corner 5 thus makes it possible to have an area of contact with the fixed blade 2 greater than the area of a point contact, as described above. The area of the region of contact between the side arm 4 and the fixed blade 2 does not need to be a contact having an area as large as the contact provided by the invention with a pin 7 of another connector. This is because, in a preferred example, the fixed blade 2 is connected to an internal aerial of a telephone. In this case, a maximum peak power of an electrical signal passing through this link is less than or equal to two watts.

In FIG. 2 showing a sectional view of the connector 1 according to the invention, the resilient switching blade 3 is in contact with a pin 7, of another connector, this pin 7 in a preferred example being a circular cylindrical pin. This other connector is, for example, a connector 70 for a coaxial cable. The free end 6 at the end of the side arm 4 provides a contact at another point on the periphery of the circular cylindrical pin 7. In the invention, the projection of the side arm 4, perpendicular to one surface of the resilient switching blade 3, is at a height of less than the diameter of the circular cylindrical pin 7. In addition, a curvature is made along this projection. This curvature has the effect of bending the projection back towards the pin 7 so that the edge of the end 6 comes into contact with a generatrix of the pin 7. Thus, when the circular cylindrical pin 7 is in contact with the switching blade 3, the arm side 4 partly embraces this pin and two contacts are therefore obtained. An additional contact is obtained by means of the end 6 of the side arm 4 while a first, quasi-point contact is obtained conventionally by means of a boss on the resilient switching blade 3.

In a variant, the projection of the side arm 4 is at least equal to the diameter of the circular cylindrical pin 7 and the side arm 4 at least partially surrounds the circular cylindrical pin 7.

The side arm 4 is produced on the switching blade 3 in an intermediate position closer to a first end 8 of the resilient switching blade 3 than the mid-height of the switching blade 3. This first end 8 is bent over so that it forms a sharp angle 9 and is oriented, in a preferred example, so as to be perpendicular to one face of the resilient switching blade 3. This orientation of the end is in the opposite direction to the direction in which the side arm 4 projects. Thus, a sharp angle 9 of rounded shape is obtained between the first end 8 and the resilient switching blade 3. This sharp angle 9 corresponds to that part of the switching blade 3 with which the first point contact is obtained.

The fixed blade 2 and the resilient switching blade 3 are inserted into a hollow body 10. This hollow body 10 has an external shape with a symmetry of revolution about an axis 11. Furthermore, this hollow body has a staircase-stepped profile with respect to the axis 11. Thus, it has a first step 12 higher, with respect to the axis 11, than a second step 13. These two steps are separated, heightwise, by a riser 14. The hollow body 10 also has two circular faces 15 and 16 perpendicular to the axis 11. A recess 17 is made in the circular face 15, the area of which is greater than that of the circular face 16. This recess 17 has, in a preferred example, a profile which is rectangular in a cutting plane perpendicular to the axis 11. In the recess 17, the two blades 2 and 3 are inserted respectively into facing walls 18 and 19. A hole 20 is made along the axis 11 on the same side as the circular face 16 and emerges in the recess 17.

Thus, in order to obtain electrical contact between the resilient switching blade 3 and the circular cylindrical pin 7, the latter is engaged in the hole 20 in the hollow body 10. The diameter and the height of this hole 20 are designed so that the circular cylindrical pin 7 remains aligned, and therefore parallel to the axis 11, whereas the pin moves the resilient switching blade 3 aside. It thus disconnects the resilient switching blade 3 from the fixed blade 2 at the moment of its introduction. A large electrical contact area, due the additional contact, is then provided between the resilient switching blade 3 and the circular cylindrical pin 7 thus introduced.

FIG. 3 shows a view of the fixed blade 2 of the connector 1 according to the invention. A first end 21 of the fixed blade 2 has an enlargement forming a contact pad 22. This contact pad 22 is intended to make a contact on receiving the corner 5 of the side arm 4 during contacting between the resilient switching blade 3 and the fixed blade 2.

A second end 23 of the fixed blade 2 is bent over so that this second end 23 is perpendicular to the fixed blade 2. This second end 23 has a through-hole 24. Likewise, in FIG. 4 showing the resilient switching blade 3 of the connector 1 according to the invention, a second end 25 of the resilient switching blade 3 is bent back in the same way as the second end 23. This second end 25 has a through-hole 26 identical to the through-hole 24. During the forming of the blades 2 and 3, the parts 23 and 25 are prestressed so that they press against the circularface 15 of the insulating hollow body 10.

FIG. 5 shows a view of the circularface of the connector 1 according to the invention. The circularface 15 of the connector 1 has two facing slots 27 and 28 into which the blades 2 and 4 respectively inserted. The two slots 27 and 28 are made in the walls 18 and 19 respectively and are wider then these walls 18 and 19, the width being measured along an axis perpendicular to the axis 11 and parallel to the planes formed by on surface of the walls 18 and 19.

Thus, after the blades 2 and 3 have inserted into the slots 27 and 28 respectively, their ends 23 and 25, by virtue of their bent over shape and their prestress, but against the circular face 15 of the connector 1 and apply pressure thereto. Thus, contact areas of the ends 23 and 25, intended to make contact with a printed circuit, are in the same contact plane is coincident with that of one face of the printed circuit board on which the connector 1 is placed. In addition, the ends 23 and 25 extend so as to come to the periphery of one edge of the circular face 15.

This allows the connector 1 to be mounted on a printed circuit using a so-called SMC surface mounting technique. Such a surface mounting technique is a technique is which the printed circuit board is not drilled with holes. In such an SMC technique, the conducting pins of a component are not allowed to pass through the printed circuit board, these pins being soldered on the opposite face of the printed circuit board from its face in contact with the component. A mounting technique other than a surface mounting technique on a printed circuit board would require the printed circuit board to be drilled with holes so as to allow, for example, the ends 23 and 25, which are not moved apart, of the blades 2 and 3 to pass through the printed circuit board. Or else, it would require holes so as to allow screws to pass through it, which screws would be fastened to the connector 1. The latter solution poses construction problems. This is because the overall size of this connector is less than the size of a rectangular parallelepiped with a width and a thickness which are equal to or less than 2.5 mm and a length equal to or less than 7.5 mm. These values are given to an accuracy of 10%. Thus, for the circular face 15, a diameter of 2.5 mm means a diameter of the through-holes 24 and 26 of less than 1.25 mm. In fact, the two through-holes 24 and 26 must have diameters such that the sum of them is less than the diameter of the circular face 15, which means a maximum diameter of 1.25 mm for the through-holes 24 and 26. In fact, the size of the through-holes is even less, since there must be sufficient space between the two through-holes 24 and 26 so as to avoid in particular any problem of parasitic coupling between the fixed blade 2 and the resilient switching blade 3. For example, a space of five times the diameter of a through-hole 24 or 26 gives a hole diameter of less than 0.4 mm. Thus, 0.4 mm holes require 0.4 mm screws, which demands screw manufacturing methods that are too expensive compared with the manufacturing cost of a connector such as the connector 1. Thus, one solution to this problem is to use a technique of surface mounting on a printed circuit.

However, the lack of relative strength of such an SMC mounting is compensated for by the second contact 6, the elastic reaction of which is not entirely supported by the anchoring but by the facing slots 27 and 28.

The through-holes 24 and 26 are situated in front of shafts 29 and 30 which are respectively formed out in the circular surface 15 of the hollow body 10. A diameter of the shafts 29 and 30 is 50% greater than the diameter of the through-holes 24 and 26. A soldering sphere, for example made of tin, is placed on the shafts 29 and 30. This sphere has a diameter inferior to the diameter of the through-holes 24 and 26 so that it can be introduced into a shaft 29 or 30. Thus, after having disposed the connector 1 on the surface of the printed circuit, the tin spheres are in contact with the printed circuit via the through-holes 24 and 26. In order to melt the tin sphere, different processes of soldering components onto a printed circuit can be used, in particular an electrical soldering iron. The parts of the ends 23 and 25 which are situated at the periphery of the edge of the circular surface 15 are heated. In a variant, the fusion of the tin sphere could also be obtained by placing the printed circuit with the connector 1 in an furnace, but only if the fusion temperature of the tin is inferior to the fusion temperature of the connector 1, during a time period sufficient to obtain the fusion of said sphere. In this case, so-called simple or double wave soldering techniques are used. It is an advantage of the shafts 29 and 30 that they permit a degassing during the fusion of the tin spheres. In fact, the fusion of the tin in the through-holes 24 and 26 provoke a filling of these latters. Thus, it must be possible to evacuate the gases resulting from the fusion of the tin. The shafts 29 and 30 permit this evacuation. Thus, the gas resulting from the fusion of the tin does not remain imprisoned in the melted tin after cooling, which makes it possible to obtain a homogeneous weld, that is in particular without air bubbles inside.

The hollow body 10 has an insulating structure 31 in which the recess 17 is made. This insulating structure 31 is inserted into a conducting skirt 32, one profile of which, along an axis such as the axis 11, corresponds to the profile described previously with respect to the hollow body 10.

FIG. 6 shows the insulating structure 31 according to the invention. The blades 2 and 3 are inserted into the slots 27 and 28 in the recess 17 in order for them to be fastened to the insulating structure 31. To do this, the fixed blade 2 and the resilient switching blade 3 are provided with an anchoring plates 37 and 38, respectively. The anchoring lates 37 and 38 are made in an intermediate position. Projecting from these plates are two side arms 39 and 40 in the case of the fixed blade 2 and 41 and 42 in the case of the resilient switching blade 3, respectively. Each side arm 39 to 42 has, at one end, an oblique fastening catch 43 to 46, respectively. The distance between two ends of the two catches of a blade is greater than the width of the facing slots 27 and 28. During insertion of the blades into the recess 17, the oblique catches 43 to 46 penetrate rebates facing the facing slots 27 and 28, thus ensuring retention of the blades 2 and 3. In the case of the switching blade 3, it is this retention which allows the elastic reaction of the second contact.

A groove is made in the insulating structure 31, on the circular face 15 side, the groove being parallel to the slots 27 and 28 and being along an axis which is perpendicular to the axis 11 and passes through the latter. The groove is interrupted at the middle of it by the recess 17. Thus, two grooves 33 and 34 are obtained, at the bottom of which holes 35 and 36 are made, respectively.

FIG. 7 shows a plug 47 which, in a preferred variant, makes it possible to align and retain the fixed blade 2 and the resilient switching blade 3. Once this plug 47 has been inserted into the recess 17, it presses each blade against the walls 18 and 19 of the recess 17. The plug 47 has a shape complementary to the shape in a cutting plane perpendicular to the axis 11 of the recess 17 and has two side arms 48 and 49. At the end of insertion of the plug 47 into the recess 17, these side arms 48 and 49 butt against the bottom of the grooves 33 and 34. The side arms 48 and 49 each have a preferably cylindrical stud 50 and 51 which are intended to be inserted into the holes 35 and 36, respectively, so as to ensure that the plug 47 is put into position with respect to the insulating structure 31. Furthermore, the top of the plug 47 has a pyramidal structure which ensures that the plug 47 is engaged easily in the recess 17.

FIG. 8 shows a conducting skirt 32 of the connector 1 according to the invention, into which the insulating structure 31 is inserted. This conducting skirt 32 forms an external casing of the hollow body 10. On the face 15 side, the metal skirt 52 has two shoulders 53 and 54 projecting parallel to the axis 11. The tops of the free ends of these two shoulders 53 and 54 lie in the same plane 55. This plane, when fastening the connector 1 to the printed circuit board, is coincident with that face of the printed circuit board on which the connector 1 is fitted. Thus, when soldering the ends 23 and 25 of the connector 1 to the conducting tracks on the printed circuit board, the shoulders 53 and 54 are themselves also soldered to a conducting track on the printed circuit board. In a preferred example, this track is connected to an earth reference potential, generally zero, thus ensuring that the conducting skirt 32 is at a zero potential with respect to potentials that may be found on the printed circuit.

When connection is made between the connector 1 and another connector connected to a coaxial cable, the conducting skirt 32 ensures electrical continuity of the screen of this coaxial cable to the reference potential on the printed circuit board. This connection between the conducting skirt 32 and the screen of the other coaxial cable is provided by a circular shell 56 (FIG. 2) of the coaxial connector 70, surrounding the circular cylindrical pin 7, in which shell the first step 12 is engaged. Once the circular shell 56 has been connected, it butts against the riser 14 of the hollow body 10 and the connector 1 can therefore provide electrical transmission between the printed circuit and an aerial connected to the coaxial cable.

FIG. 9 shows an example of the use of the connector 1 according to the invention. In a preferred example, the connector 1 is placed in a mobile telephone 57. An internal aerial 58 of the mobile telephone 57 is connected via the second end 23 to the fixed blade 2. The second end 25 of the resilient switching blade 3 is connected to a transmitter/receiver circuit 59 in the mobile telephone 57. In this example, the mobile telephone 57 is used normally, that is to say the internal aerial 58 is used for transmitting and receiving information. A user having a vehicle 60 on the outside of which an external aerial 61 is fixed, thus has the possibility of connecting this external aerial 61 to the mobile telephone 57. To do this, one end of the external aerial 61 has a coaxial cable 62 provided with a coaxial connector 63. This coaxial connector 63, similar to the coaxial connector 70, is inserted into the connector 1 of the mobile telephone 57, thus switching from the internal aerial 58 to the external aerial 61. Thus the mobile telephone 57 uses an aerial 61 allowing it to transmit at a higher power than if the internal aerial 58 were used.

In a preferred example, the fixed blade 2 and the resilient switching blade 3 are obtained by moulding and are made of bronze. The insulating structure 31, preferably made of polyvinyl chloride, is obtained by moulding, as is the conducting skirt 32, which is made of iron.

FIG. 10 is a perspective view in axial section of a switch connector according to the invention.

The miniature switch connector illustrated in FIG. 10 is intended to be surface-mounted on a printed-circuit board, for example of a mobile telephone.

The connector has a hollow body 100 of cylindrical shape made of plastic, such as polyimide. This body is preferably moulded, which technique allows precise and reproducible manufacturing tolerances to be guaranteed.

The hollow body 100 comprises, at one of its ends, an opening 200 intended to receive a connection plug 300 which engages, during its insertion into this opening 2, with a resilient contact blade 400 in order to separate the latter from a conductive surface 500. This contact blade 400 and this conductive surface 500 are connected to two coplanar conductive areas 600, 700 located at the end of the hollow body on the opposite side from the opening 200.

According to the invention, the conductive surface 500 consists here of a metallized layer applied to part of the internal surface 800 of the hollow plastic body 1. Moreover, the two conductive areas 600, 700 consist of two metallized layers applied to the external plane face 900 of the hollow body 100 on the opposite side from the opening 200.

As may be seen in FIG. 10, the contact blade 400 has an end 410 which is fixed to the internal surface 800 of the hollow body 100 close to that end of the latter which is on the opposite side from the opening 200.

Moreover, the two metallized layers 600, 700 applied to the external plane face 900 each form a continuous metallized layer which passes round the internal edge of the hollow body, one of which is in contact with the end 110 of the contact blade 400 and the other of which is in contact with the metallized layer 500 applied to the internal surface 800 of the hollow body 100.

Furthermore, the metallized layer 600a which is in contact with the end 410 of the contact blade 400 extends below this end 410.

Moreover, the conductive surface 500 applied to the internal surface 800 of the hollow body 100 forms a strip facing the resilient contact blade 400. This strip extends over approximately the entire length of the internal surface 800.

Preferably, the end 410 of the resilient contact blade 400 is soldered to the metallized layer 600*a* which extends below this end 410. However, it could also be fixed to it by any other known means.

In addition, the external surface 112 of the hollow body 100 is covered with a metallized layer 113 forming a screen.

Furthermore, the external plane face 900 of the hollow body 100 comprises at least a third metallized layer 914 which extends at least on one side between the other two conductive areas 600 and 700 and which is connected to the metallized layer 113 forming the external screen of the hollow body 100 and making it possible to achieve electrical continuity and earthing of the printed circuit.

In the example illustrated, the three conductive areas or metallized layers 600, 700, 914 respectively are applied to the periphery of a flange 15 which projects outwards at the end of the hollow body 100.

Moreover, as indicated in FIG. 1, the plane face 900 having the metallized layers 600, 700, 914 includes an opening 116 which may be closed off by a retaining piece 117, the lateral surface 118 of which is in contact with the end 410 of the contact blade 400. This arrangement makes it possible to consolidate the already strong fixing of the contact blade 400 to the internal surface of the hollow body.

This retaining piece can be provided in order to prevent disbanding or pull-out and to limit such stresses, during the lifetime of the connector, thus allowing the possible number of connections and disconnections when the connector or the external aerial is plugged in to be increased.

As already indicated in FIG. 1, that end of the contact blade which is adjacent to the opening 200 for inserting the connecting plug 300 has, on the one hand, a part bent over in a direction away from the metallized layer 500 applied to the internal surface 800 of the hollow body 100 and, on the other hand, a lateral finger 420 directed towards the metallized layer 500 and bearing on the latter. The shape of the bent-over part 419 is such that the insertion of the plug 300 into the opening 200 causes the contact blade to move in a direction away from the metallized layer 500 and causes the lateral finger 420 to separate from this layer 500.

The diameter of the opening 200 and the shape of the end of the contact blade 400 are designed so that the plug 300 remains centred, whereas it moves the contact blade 400 aside in order to disconnect it from the conductive surface 500.

When the plug 300 has been completely inserted into the hollow body 100, a large contact area is established between this plug 300 and the contact blade 400.

The metallized layers 500, 600, 600*a*, 700 113, 914 are preferably produced using the technique of metallizing plastics, known by the name MID.

The above metallized layers may also be coated with a layer of tin-lead alloy covered with a thin layer of gold or silver in order to improve the solderability.

Since the three metallized layers or conductive areas 600, 700, 914 lie strictly in the plane of the plane face 900 of the hollow body, it is very easy to solder them to the conductive areas on a printed-circuit board.

The surface-mounting is thus considerably simplified and the coplanarity problems usually encountered are eliminated.

In fact, it is completely possible to ensure the desired coplanarity tolerances since the base of the moulded hollow body corresponds to a perfectly defined reference plane (having precise and reproducible manufacturing tolerances) and since the layers 600, 700, 914 are directly metallized (with a thickness of about 15 to 20 microns) on this reference base.

Furthermore, such a connector makes it possible to ensure high-quality electrical connection either to the internal aerial when the resilient contact blade 400 and the conductive surface 500 are in contact with each other or to the external aerial when they are separated by the insertion of the coaxial plug into the hollow body.

Of course, the invention is not limited to the example that has just been described and many modifications may be made to it without departing from the scope of the invention.

FIG. 11 describes a further embodiment of a connector according to the present invention compared to the connector shown in FIG. 1. This embodiment is much smaller in its longitudinal extension by fixing the rear end of the movable blade on a side extension 80 of the housing 90 by means of two tongues that are anchored in corresponding slits. This allows a perfect holding strength without the need of a plug 47 as shown in FIG. 1. The longitudinal extension of the hollow body 90 can therefore be reduced essentially to the length of the male connector pin which leads to a reduction of the length of the connector housing of about 50%.

Figure 1:
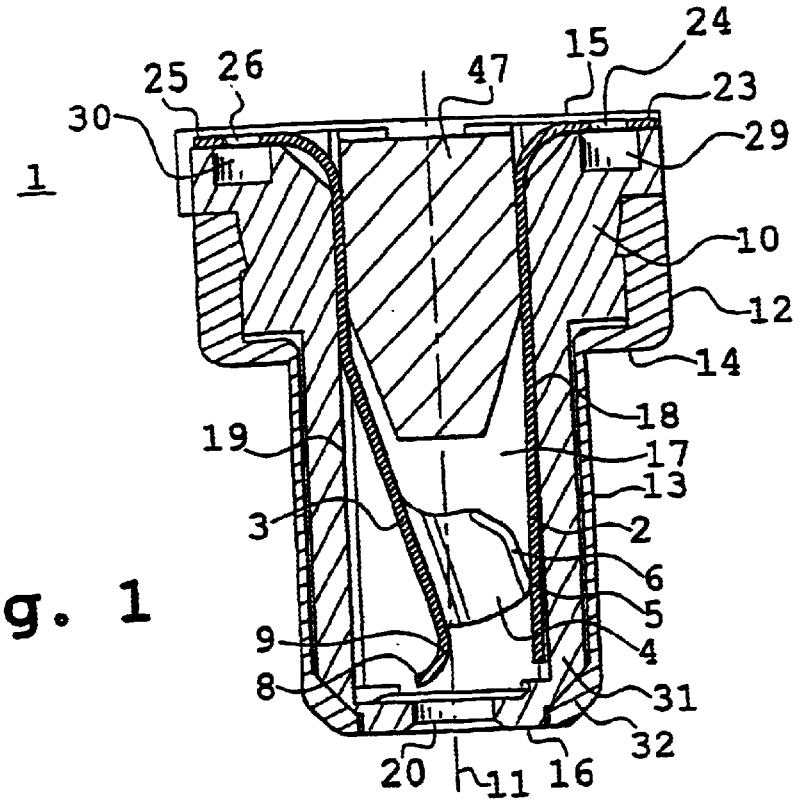
Figure 2:
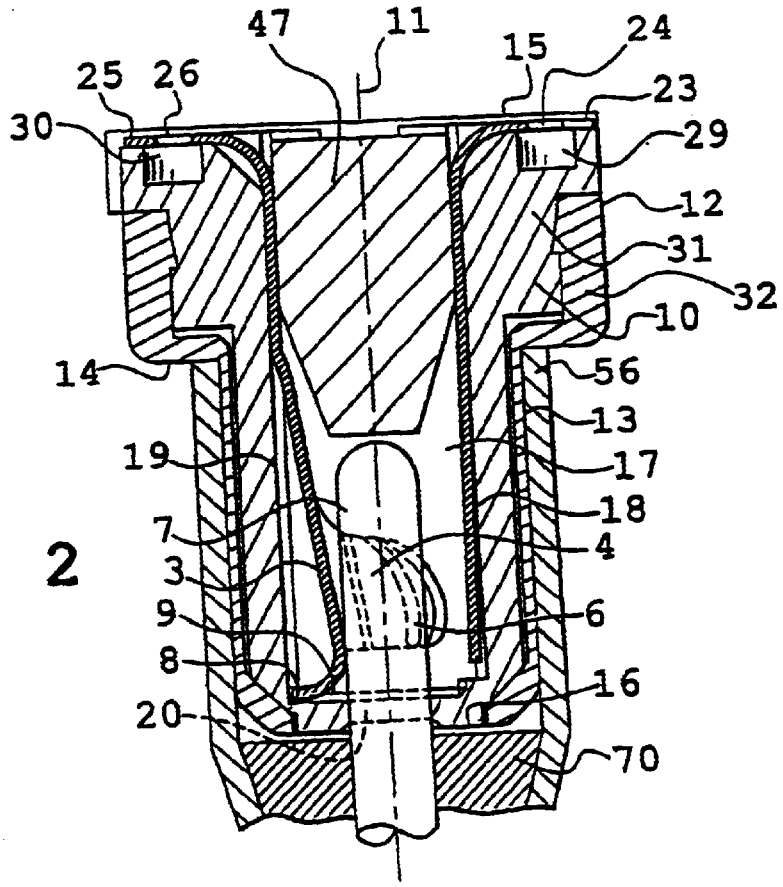
Figure 3:
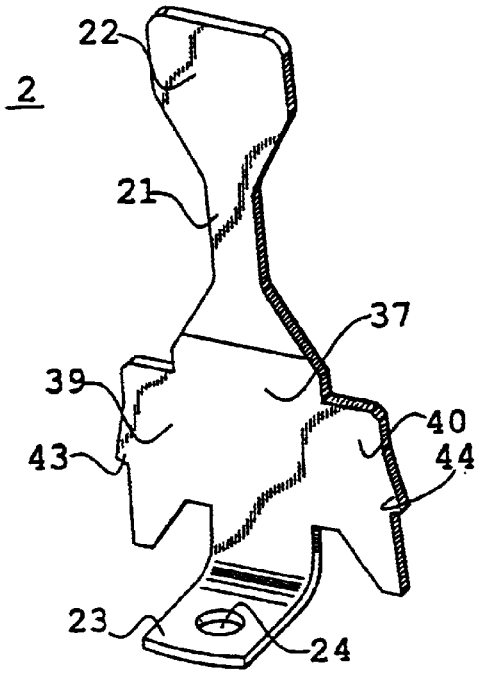
Figure 4:
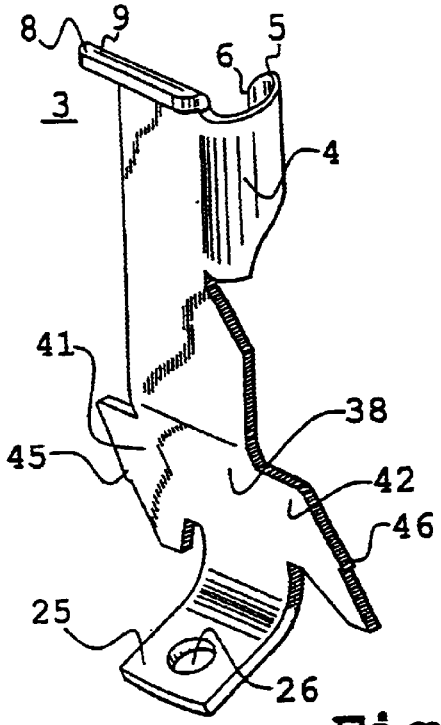
Figure 5:
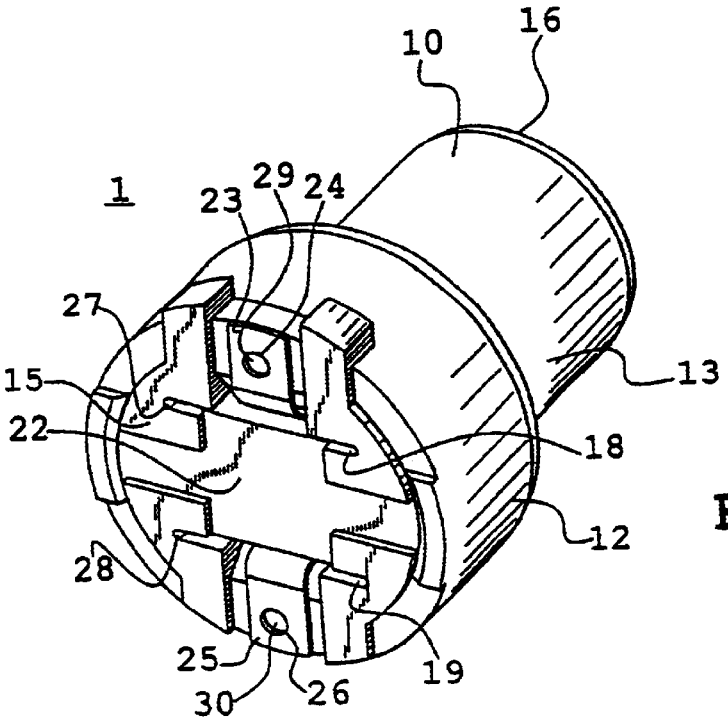
Figure 6:
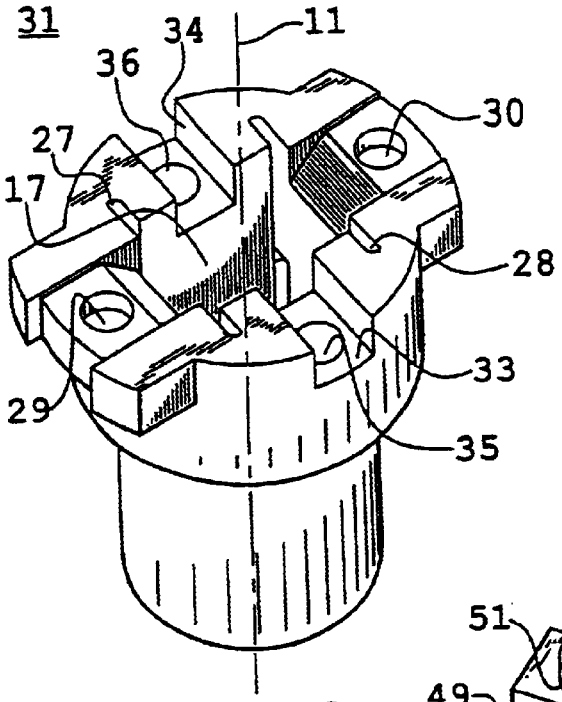
Figure 7:
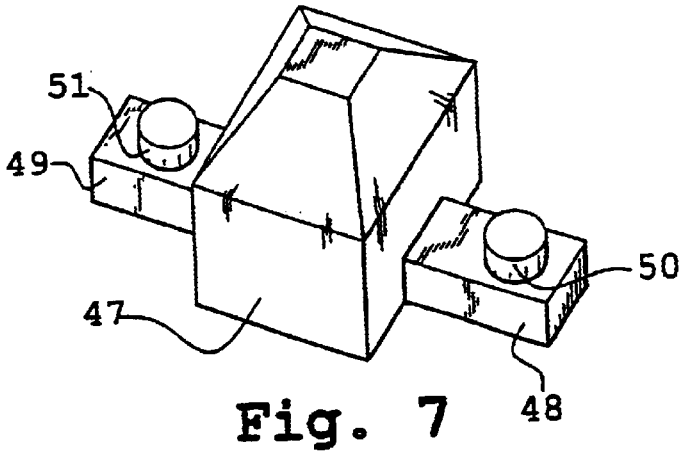
Figure 8:
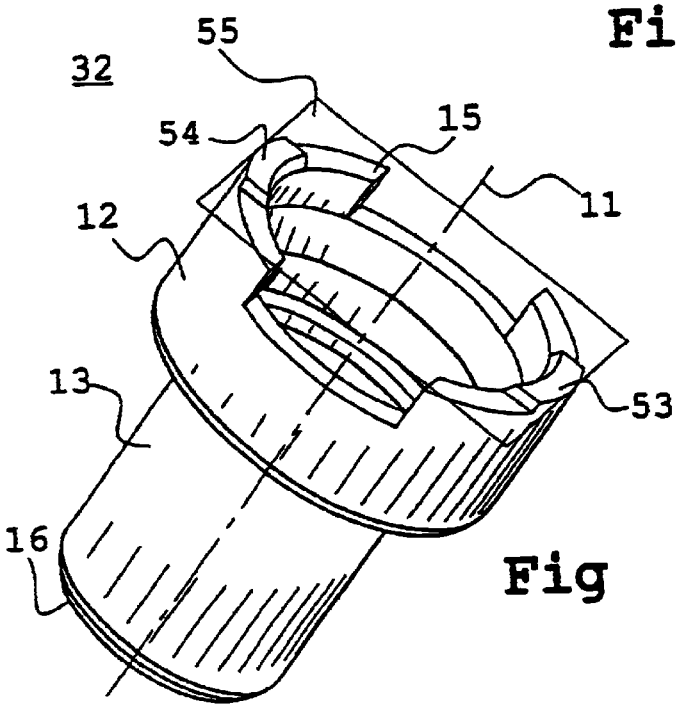
Figure 9:
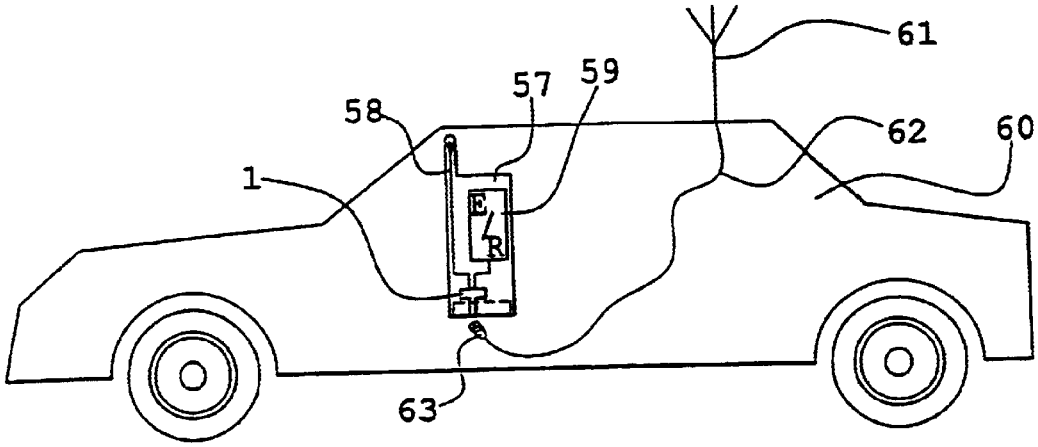
Figure 10:
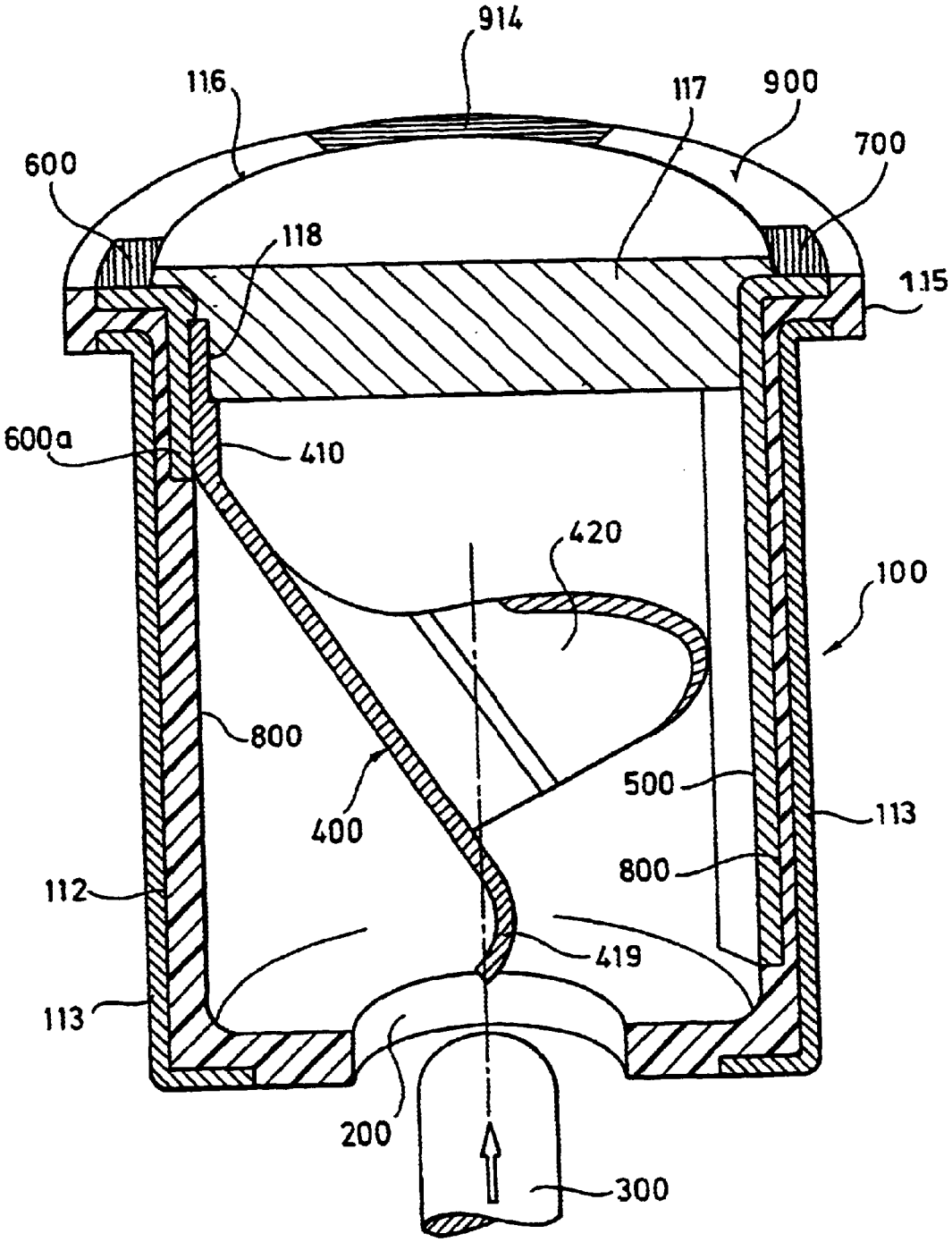

It goes without saying that the idea of the embodiment as shown in FIG. 10 of the use of metallized surface can also be applied to this embodiment accordingly. That is, the fixed blade 2 can be replaced by a metallized surface and the switching blade 3 can be linked to a metallized area for further connecting it with other elements of a circuit.

Figure 11:
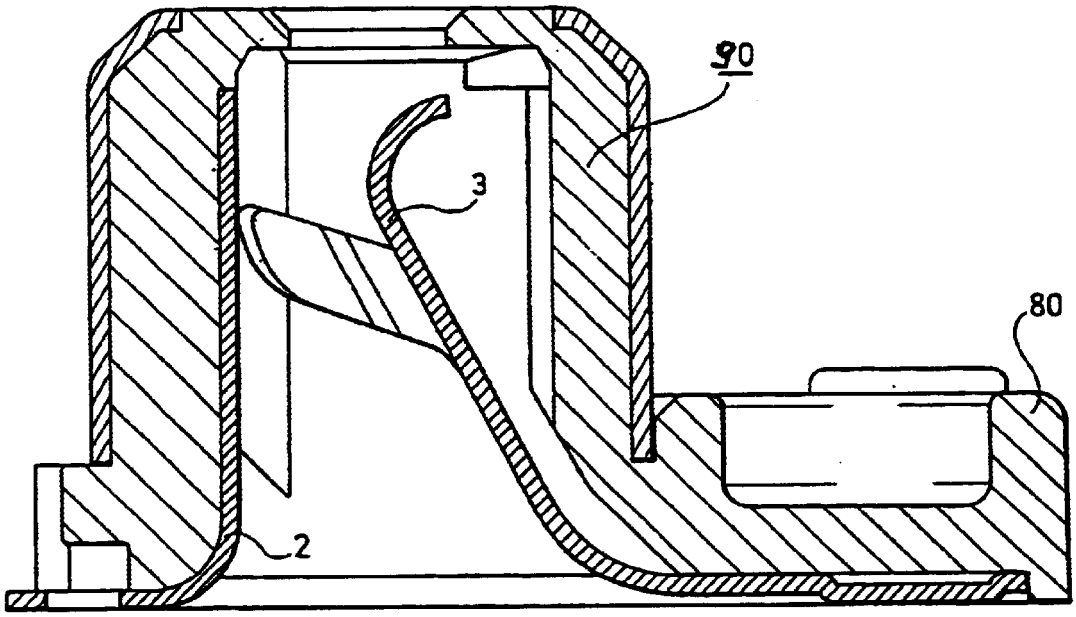
Figure 12:
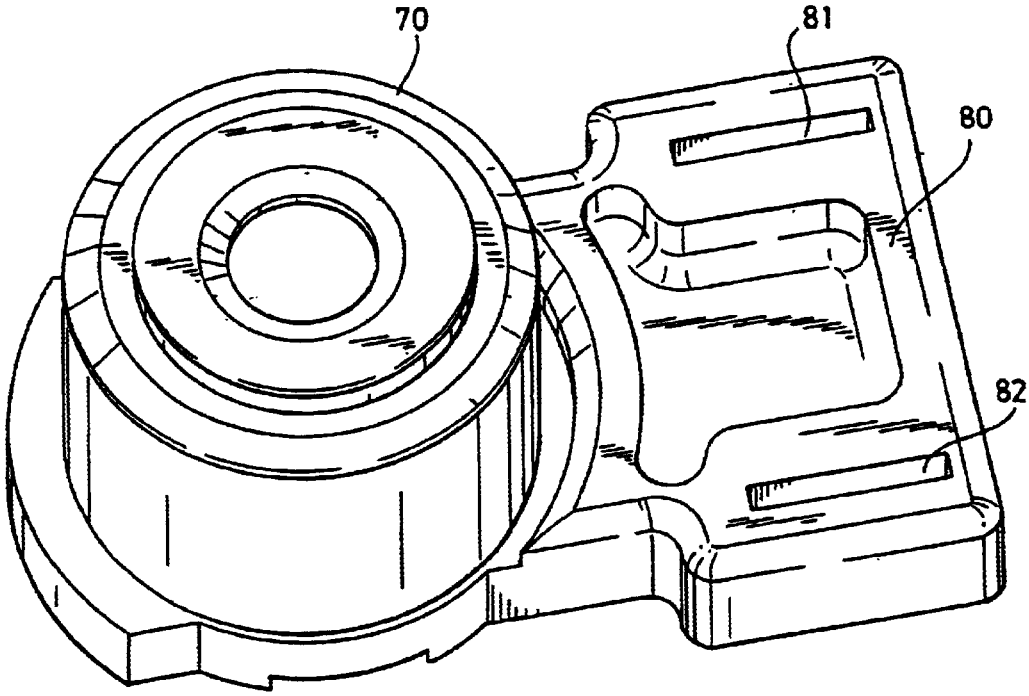
FIG. 12 shows a perspective view of the housing with the fixing slits 81 and 82 on the side extension at the rear end of the hollow body.
Figure 13:
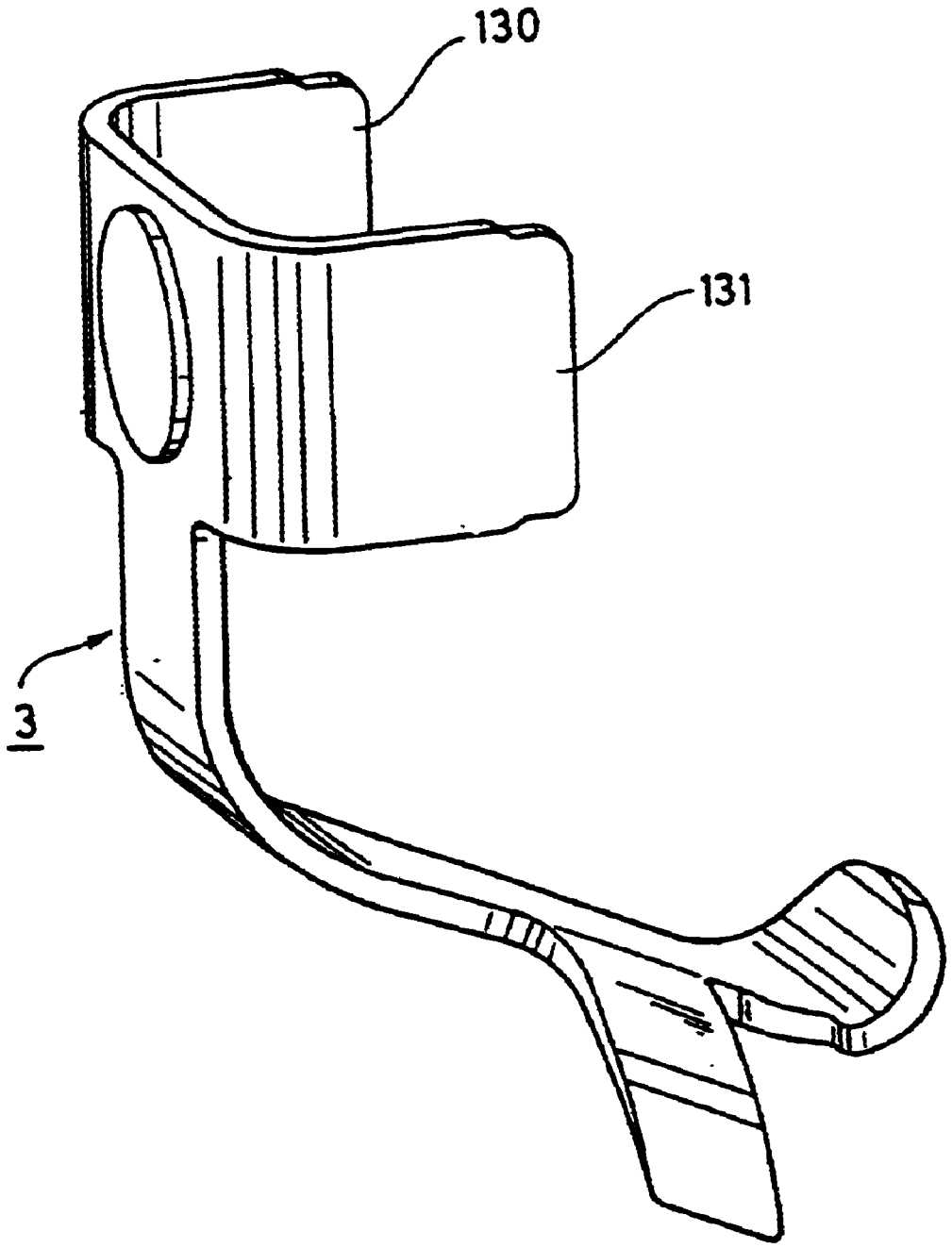
FIG. 13 shows the movable switching blade 3 with its fixing tongues 130, 131.

The connector shown in FIG. 11 is therefore perfectly adapted for the intended use as a connector on mobile phones or the like.

What is claimed is:

1. Connector provided with a device for switching between two channels, this device including two blades each having a first free end and a second end, a first, fixed blade connected to a first channel and a second resilient switching blade exerting a contact pressure either on the first, fixed blade or on a pin of another connector, this pin being connected to a second channel and being inserted as required into the connector and wherein the second end of each blade is bent over in a same contact plane so that it is parallel to a contact surface on a printed circuit board and further comprising a hollow body inside which said device for switching is mounted, characterized in that the pin of the other connector comes into contact with the second blade at two points which are offset one with respect to the other on the periphery of the pin, a second contact of the second blade with this pin is obtained because this second blade includes a curved side arm which projects so as to be perpendicular to one surface of this second blade and a curvature of which is made along this projection so that upon contact with the pin, the second contact of the second blade biases the second blade against the pin, and that the second end is prestressed so that they are parallel to a contact surface on a printed circuit board and exert a pressure on the base of the hollow body, and one of the blades is provided with an anchoring plate, in an intermediate position, from which two side arms extend, each having an oblique catch for being fastened in a slot in the insulating structure.

2. Connector according to claim 1, characterized in that the curved side arm is in an intermediate position closer, on the other side of the half, to a first, bent-over end of the resilient switching blade.

3. Connector according to claim 1, characterized in that the overall size of this connector is less than the size of a rectangular parallelepiped with a width and a thickness approximately equal to or less than 2.5 millimeters and a length approximately equal to or less than 7.5 millimeters and in that this connector has means so that it is mounted on a printed circuit board using a surface mounting technique.

4. Connector according to claim 1, characterized in that the blades are drilled with a through-hole at their second ends.

5. Connector according to claim 1, characterized in that this device is inserted into an insulating structure which is itself inserted into a conducting skirt.

6. Connector according to claim 1, characterized in that it includes an aligning and retaining plug inserted between the blades.

7. Connector according to claim 1, characterized in that the two blades are fixed in a hollow body having at its rear end a side extension extending perpendicular to the longitudinal axis of the connector wherein the resilient blade is anchored with its rear end.

8. Connector provided with a device for switching between two channels, this device including two blades each having a first free end and a second end, a first, fixed blade connected to a first channel and a second resilient switching blade exerting a contact pressure either on the first, fixed blade or on a pin of another connector, this pin being connected to a second channel and being inserted into the connector and wherein the second end of each blade is bent over in a same contact plane so that the blade is parallel to a contact surface on a printed circuit board and further comprising a hollow body inside which said device for switching is mounted, characterized in that the pin of the other connector comes into contact with the second blade at two points which are offset one with respect to the other on the periphery of the pin a second contact of the second blade with this pin is obtained because this second blade includes a curved side arm which projects so as to be perpendicular to one surface of this second blade and a curvature of which is made along this projection, and that the second end is prestressed so that they are parallel to a contact surface on a printed circuit board and exert a pressure on the base of the hollow body, and one of the blades is provided with an anchoring plate in an intermediate position, from which two side arms extend, each having an oblique catch for being fastened in a slot provided for this purpose in the insulating structure, and characterized in that the switching blade and the fixed contact blade being a particular conductive surface, each being connected to a respective conductive area, said conductive surface comprising of a metallized layer applied to part of the internal surface of the hollow plastic body and the two conductive areas are coplanar and comprise two metallized layers applied to the external plane face of the hollow body which is on the opposite side from the opening.

9. Connector according to claim 8, characterized in that the contact blade has one end which is fixed to internal surface of the hollow body close to that end of the latter which is on the opposite side from the said opening.

10. Connector according to claim 8, characterized in that the external surface of the hollow body is covered with a metallized layer forming a screen.

11. Connector according to claim 8, characterized in that plane face having said metallized layers includes an opening closed off by a retaining piece, the lateral surface of which is in contact with the end of the resilient contact blade.

12. Connector according to claim 8, characterized in that the end of the resilient contact blade which is adjacent to the opening for inserting the plug has, on the one hand, a part bent over in a direction away from the metallized layer applied to the internal surface of the hollow body and, on the other hand, a side arm directed towards the said metallized layer and bearing on the latter, the shape of the said bent-over part being such that the insertion of the plug into the said opening causes the resilient contact blade to move in a direction away from the said metallized layer and causes the said side arm to separate from this layer.

13. Connector according to claim 9, characterized in that the two metallized layers applied to said external plane face each form a continuous metallized layer, one of which is in contact with the end of the resilient contact blade and the other of which is in the hollow body.

14. Connector according to claim 10, characterized in that said external plane face of the hollow body comprises at least a third metallized layer which extends at least on one side between the other two metallized layers and which is connected to the metallized layer forming the external screen of the hollow body.

15. Connector according to claim 13, characterized in that the metallized layer which is in contact with the end of the resilient contact blade extends below this end.

16. Connector according to claim 13, characterized in that the metallized layer applied to the internal surface of the hollow body forms a strip, located as to face the resilient contact blade, that blade extending over approximately the entire length of the said internal surface.

17. Connector according to claim 14, characterized in that the three metallized layers are applied to a flange which projects outwards at the end of the hollow body.

18. Connector according to claim 15, characterized in that the end of the resilient contact blade is soldered to the metallized layer which extends below this end.

19. Connector provided with a device for switching between two channels, this device including two blades each having a first free end and a second end, a first, fixed blade connected to a first channel and a second resilient switching blade exerting a contact pressure either on the first, fixed blade or on a pin of another connector, this pin being connected to a second channel and being inserted into the connector and wherein the second end of each blade is bent over in a same contact plane so that the blade is parallel to a contact surface on a printed circuit board and further comprising a hollow body inside which said device for switching is mounted, characterized in that the pin of the other connector comes into contact with the second blade at two points which are offset one with respect to the other on the periphery of the pin a second contact of the second blade with this pin is obtained because this second blade includes a curved side arm which projects so as to be perpendicular to one surface of this second blade and a curvature of which is made along this projection, and that the second end is prestressed so that they are parallel to a contact surface on a printed circuit board and exert a pressure on the base of the hollow body, and one of the blades is provided with an anchoring plate in an intermediate position, from which two side arms extend, each having an oblique catch for being fastened in a slot provided for this purpose in the insulating structure, and characterized in that the hollow body has at its rear end a side prolongation extending perpendicular to the longitudinal axis of the connector wherein the resilient blade is anchored with its rear end, and characterized in that said rear end of said resilient blade has two tongues entering into two slots in the side prolongation of said hollow body.

20. Connector according to claim 19, characterized in that the housing of the connector is longitudinally open on both sides, permitting to reduce the length of the connector in its longitudinal direction essentially to the length of the corresponding male connector pin.

21. Connector according to claim 19, characterized in that the switching blade and the fixed blade are connected to two conductive areas consisting of a metallized layer applied on an internal surface of said hollow body.

22. Connector according to claim 21, characterized in that said fixed blade being a conductive surface comprising a metallized layer applied to a part of the inner surface of the hollow body.

* * * * *